US005208635A

United States Patent [19]

Reese et al.

[11] Patent Number: 5,208,635

[45] Date of Patent: May 4, 1993

[54] APPARATUS FOR ELECTRICALLY COUPLING A CONDUCTIVE LAYER OF A PHOTORECEPTOR TO A REFERENCE POTENTIAL

[75] Inventors: Scott A. Reese, Farmington; Richard M. Dastin, Fairport; Douglas W. Gates, Rochester, all of N.Y.

[73] Assignee: Xerox Corporation, Stamford, Conn.

[21] Appl. No.: 776,941

[22] Filed: Oct. 15, 1991

[51] Int. Cl.[5] ..... G03G 15/02

[52] U.S. Cl. ..... 355/219; 355/212; 361/221

[58] Field of Search ..... 355/212, 213, 219, 202, 355/210, 211; 361/221, 220, 212, 214

[56] References Cited

U.S. PATENT DOCUMENTS 3,697,163 10/1972 Jordan ..... 355/212
4,027,967 6/1977 Euler ..... 355/220
4,344,698 8/1982 Zeman ..... 355/219
4,402,593 9/1983 Bernard et al. ..... 355/212

FOREIGN PATENT DOCUMENTS 60-134274 7/1985 Japan .

*Primary Examiner*—A. T. Grimley
*Assistant Examiner*—J. E. Barlow, Jr.

[57] ABSTRACT

An apparatus for electrically coupling a conductive layer of a photoreceptor to a reference potential, the photoreceptor being positionable between an operative position and a replacement position. The apparatus includes an electrically conductive brush which is electrically coupled to the reference potential. The apparatus further includes a mechanism for moving the conductive brush into electrical contact with the conductive layer in response to the photoreceptor being moved to the operative position and out of electrical contact with the conductive layer in response to the photoreceptor being moved to the replacement position.

16 Claims, 4 Drawing Sheets

APPARATUS FOR ELECTRICALLY COUPLING A CONDUCTIVE LAYER OF A PHOTORECEPTOR TO A REFERENCE POTENTIAL

This invention relates generally to an electrophotographic printing machine and, more particularly, concerns an apparatus for electrically coupling a conductive layer of a photoreceptor to a reference potential.

The marking engine of an electronic reprographic printing system is frequently an electrophotographic printing machine. In an electrophotographic printing machine, a photoreceptor or photoconductive member is charged to a substantially uniform potential to sensitize the surface thereof. The charged portion of the photoreceptor is thereafter selectively exposed in an imaging zone to a light source such as a raster output scanner. Exposure of the charged photoreceptor dissipates the charge thereon in the irradiated areas. This records an electrostatic latent image on the photoreceptor corresponding to the informational areas contained within the original document being reproduced. After the electrostatic latent image is recorded on the photoreceptor, the latent image is developed by bringing a developer material into contact therewith. Generally, the developer material comprises toner particles adhering triboelectrically to carrier granules. The toner particles are attracted to the latent image from the carrier granules to form a toner image on the photoreceptor which is subsequently transferred to a copy sheet. The copy sheet is then heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complimentary thereto. This process is repeated a plurality of cycles for differently colored images and their respective complimentarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy.

In each of the above processes of printing, the photoreceptor usually includes a conductive layer which is electrically coupled to a particular reference potential, usually ground potential. In order to achieve the above, the photoreceptor usually includes a grounding strip on a marginal portion thereof. The grounding strip may be a corresponding portion of the conductive layer which is exposed, or alternatively, may be a conductive strip which is in turn electrically coupled to the conductive layer. Moreover, a conductive member which is electrically coupled to the particular reference potential is usually mounted at a fixed location adjacent the photoreceptor so as to be in contact with the grounding strip during normal operation of the printing machine thereby electrically coupling the conductive layer to the particular reference potential.

The photoreceptor is positioned at an operative position during normal operation of the printing machine. Thereafter, in some printing machines, when it is desired to replace the photoreceptor, for example due to wear or damage, the photoreceptor is moved to a replacement position to allow for removal of the photoreceptor from the supporting structure upon which it is entrained. A new photoreceptor is then placed on the above supporting structure so as to entrain such photoreceptor thereon. The new photoreceptor is then moved to the operative position so that normal operation of the printing machine may resume.

During replacement of the photoreceptor, a problem may arise due to physical interference by the conductive member. More specifically, the conductive member may need to be manually moved out of contact with the photoreceptor to allow the photoreceptor to be moved to the replacement position. Also, the position of the conductive member may need to be manually adjusted to allow the new photoreceptor to be moved to the operative position.

In addition, grounding devices heretofore utilized in the art require precise relative placement of certain machine components due to the need for operative interaction of such components. Such precision requirements result in increased costs.

The following disclosures may be relevant to various aspects of the present invention:

U.S. Pat. No. 4,027,967; Patentee: Euler; Issued: Jun. 7, 1977;

U.S. Pat. No. 4,344,698; Patentee: Zeman; Issued: Aug. 17, 1982;

U.S. Pat. No. 4,402,593; Patentee: Bernard et al.; Issued: Sep. 6, 1983;

JPPN-60-134274; Applicant: Yuuji Kida; Publication Date: Jul. 17, 1985.

The relevant portions of the foregoing disclosures may be briefly summarized as follows:

U.S. Pat. No. 4,027,967 describes an electrophotographic apparatus having a movable web of plastic material on which is disposed a vapor-deposited conductive layer and a photoconductor layer. The conductive layer is in slidable contact with a fixed potential stationary electrical contact having a graphite surface.

U.S. Pat. No. 4,344,698 discloses an electrophotographic apparatus of the kind utilizing a flexible photoconductor film or web including a support and photoconductive layer sandwiching a conducting layer which comprises a grounding member having an incising edge. The grounding member is electrically coupled to a reference potential and urged into a predetermined cutting position to incise the photoconductive layer and to effect contact of the conductive layer as film is moved therepast along the operative path of the apparatus.

U.S. Pat. No. 4,402,593 relates to an electrophotographic apparatus in which a photoconductor, movable past a plurality of electrophotographic stations, has an insulating support web with, in turn, an electrically conductive layer, and a photoconductive layer disposed thereon, in which there is or can be an electrical connection between the electrically conductive layer and a stationary contact at a fixed potential.

JPPN-60-134274 discloses a copying machine using a belt-shaped photosensitive body. The belt-shaped photosensitive body includes a lower conductor layer which is electrically coupled to a pair of conductive grounding brushes.

In accordance with one aspect of the present invention, there is provided an apparatus for electrically coupling a conductive layer of a photoreceptor to a reference potential, the photoreceptor being positionable between an operative position and a replacement position. The apparatus includes an electrically conductive member, the conductive member being electrically coupled to the reference potential. The apparatus further includes a mechanism for moving the conductive member into electrical contact with the conductive layer in response to the photoreceptor being moved to the operative position and out of electrical contact with the conductive layer in response to the photoreceptor being moved to the replacement position.

Pursuant to another aspect of the present invention, there is provided a printing machine which includes a photoreceptor which is positionable between an operative position and a replacement position, wherein the photoreceptor includes an electrically conductive layer. The printing machine further includes an electrically conductive member, the conductive member being electrically coupled to a reference potential. Additionally, the printing machine includes a mechanism for moving the conductive member into electrical contact with the conductive layer in response to the photoreceptor being moved to the operative position and out of electrical contact with the conductive layer in response to the photoreceptor being moved to the replacement position.

Other features of the present invention will become apparent as the following description proceeds and upon reference to the drawings, in which.

Figure 1:
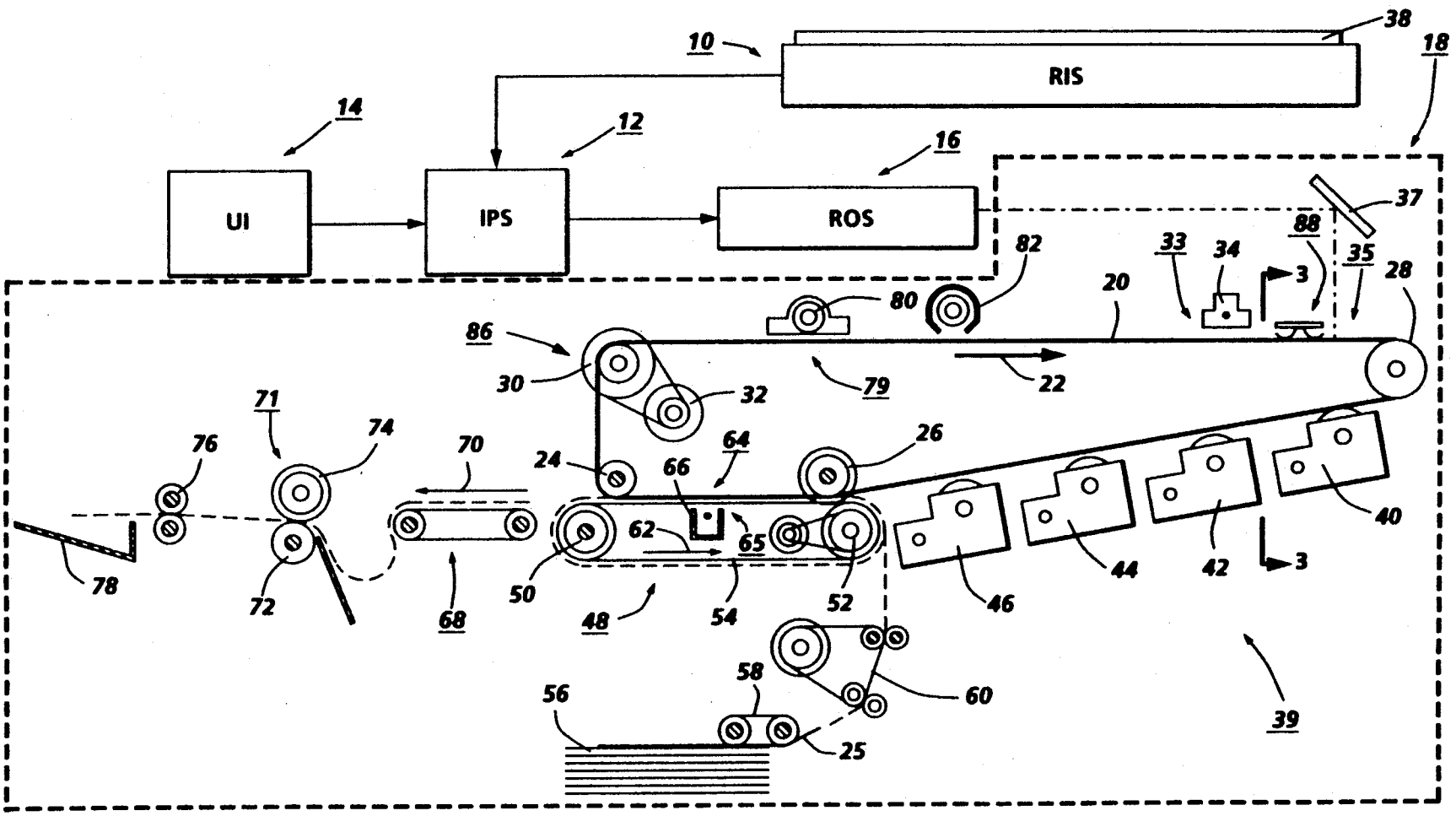
FIG. 1 is a schematic elevational view showing an electrophotographic printing machine incorporating the features of the present invention therein.
Figure 3:
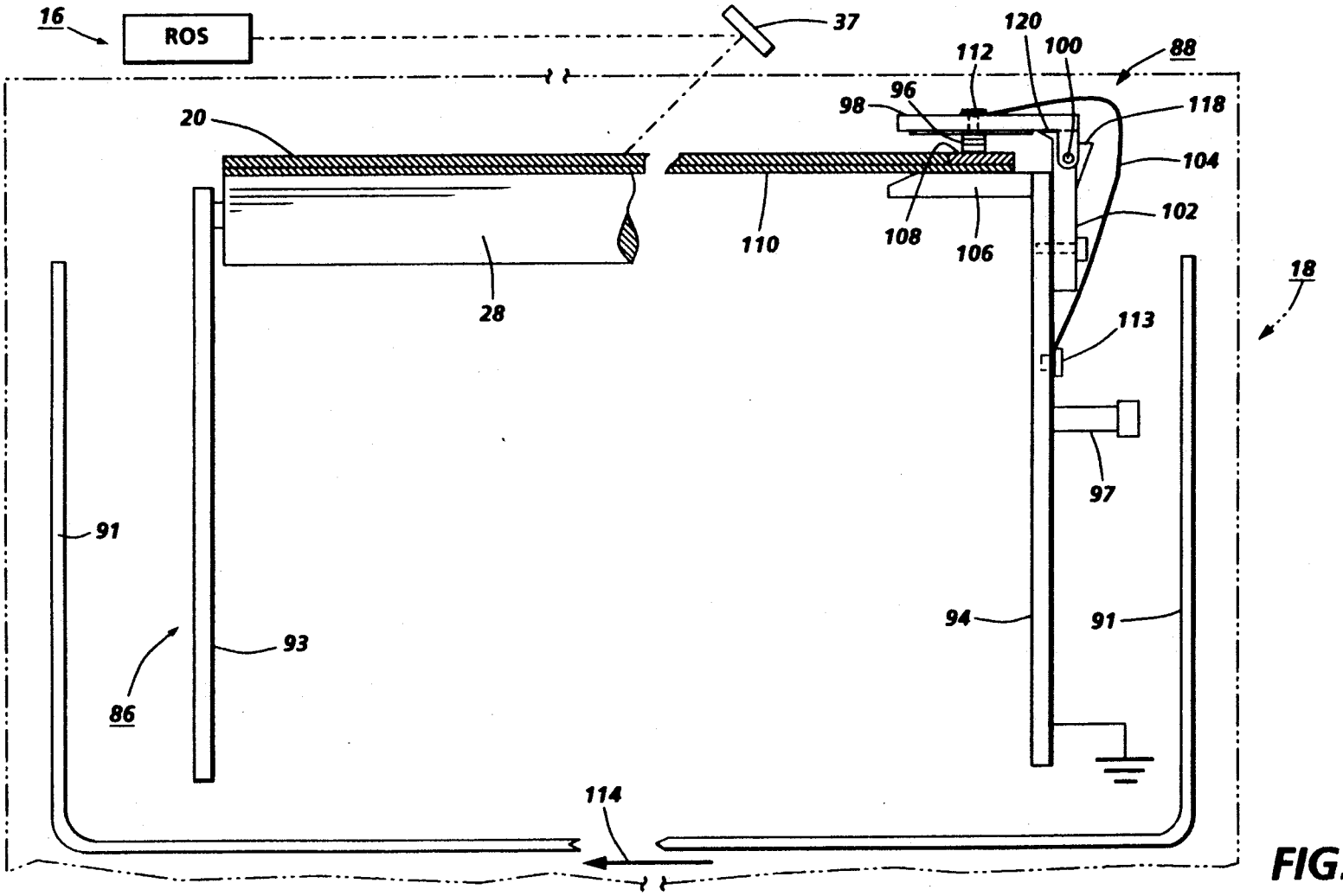
Figure 4:
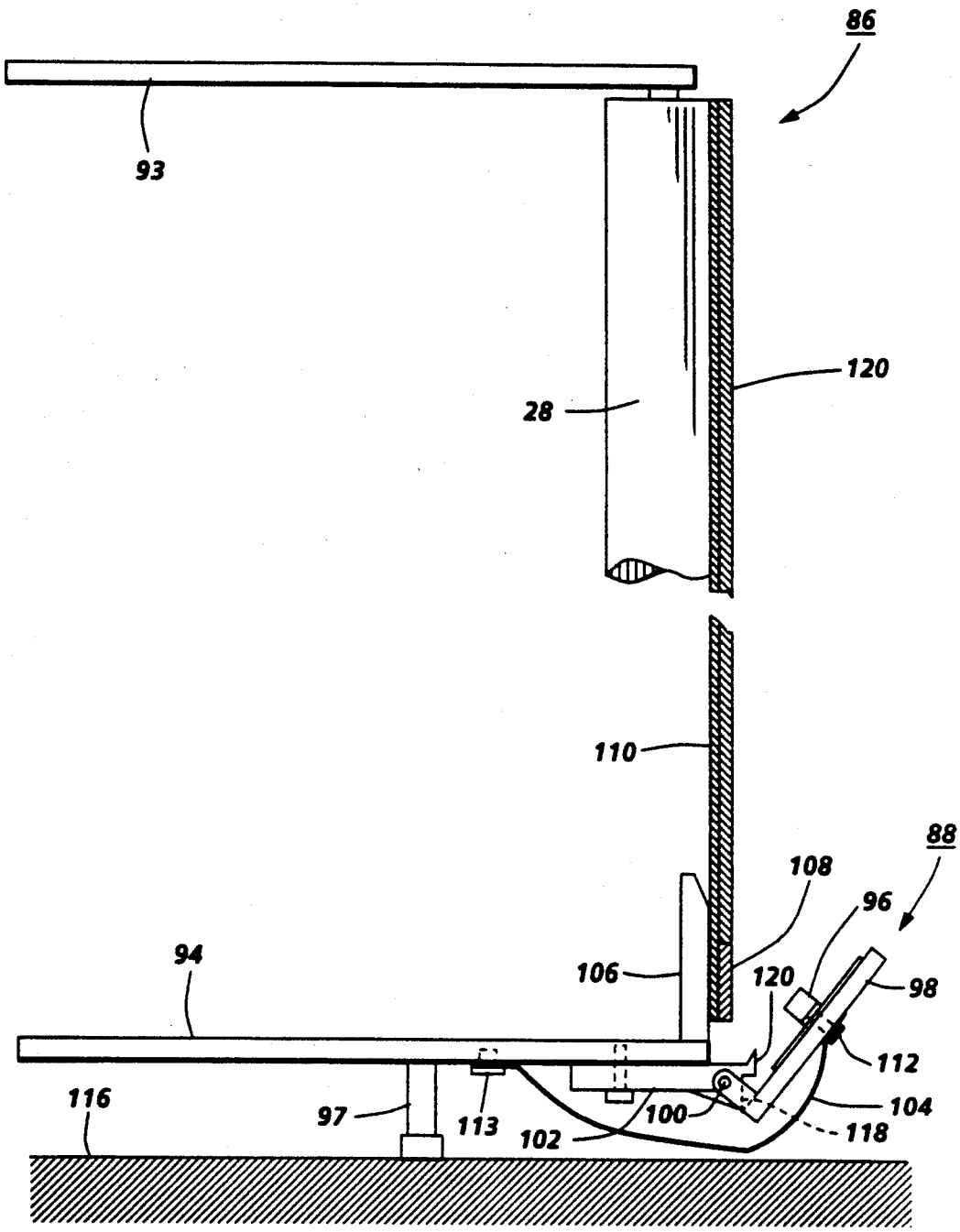

FIG. 3 is a sectional elevational view taken in the direction of arrows 3—3 in FIG. 1 of the module and module drawer used in the electrophotographic printing machine of FIG. 1 and showing the photoconductive belt positioned in the operative position; and FIG. 4 is a view of the module similar to FIG. 3 but showing the module removed from the printing machine and further showing the the photoconductive belt positioned in the replacement position.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements. FIG. 1 is a schematic elevational view showing an electrophotographic printing machine incorporating the features of the present invention therein. It will become evident from the following discussion that the present invention is equally well suited for use in a wide variety of printing systems, and is not necessarily limited in its application to the particular system shown herein.

Turning initially to FIG. 1, during operation of the printing system, a multi-color original document 38 is positioned on a raster input scanner (RIS), indicated generally by the reference numeral 10. The RIS contains document illumination lamps, optics, a mechanical scanning drive, and a charge coupled device (CCD array). The RIS captures the entire image from original document 38 and converts it to a series of raster scan lines and moreover measures a set of primary color densities, i.e. red, green and blue densities, at each point of the original document. This information is transmitted as electrical signals to an image processing system (IPS), indicated generally by the reference numeral 12. IPS 12 converts the set of red, green and blue density signals to a set of colorimetric coordinates. The IPS contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The operator actuates the appropriate keys of UI 14 to adjust the parameters of the copy. UI 14 may be a touch screen, or any other suitable control panel, providing an operator interface with the system. The output signal from UI 14 is transmitted to IPS 12. The IPS then transmits signals corresponding to the desired image to ROS 16, which creates the output copy image. ROS 16 includes a laser with rotating polygon mirror blocks. Preferably, a nine facet polygon is used. The ROS illuminates, via mirror blocks 37, the charged portion of a photoreceptor or photoconductive belt 20 of a printer or marking engine, indicated generally by the reference numeral 18, at a rate of about 400 pixels per inch, to achieve a set of subtractive primary latent images. The ROS will expose the photoconductive belt to record three latent images which correspond to the signals transmitted from IPS 12. One latent image is developed with cyan developer material. Another latent image is developed with magenta developer material and the third latent image is developed with yellow developer material. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22. As the belt is advanced, it remains electrically coupled to a particular reference potential, usually electrical ground, by a grounding mechanism, generally designated by the reference numeral 88.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charged photoconductive surface is rotated to an exposure station, indicated generally by the reference numeral 35. Exposure station 35 receives a modulated light beam corresponding to information derived by RIS 10 having the multi-colored original document 38 positioned thereat. The modulated light beam impinges on the surface of photoconductive belt 20. The beam illuminates the charged portion of the photoconductive belt to form an electrostatic latent image. The photoconductive belt is exposed three times to record three latent images thereon.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is positioned substantially adjacent the photoconductive belt, while in the non-operative position, the magnetic brush is spaced therefrom. In FIG. 1, developer unit 40 is shown in the operative position with developer units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper (not shown) extends between belts 54 and moves in unison therewith. A sheet 25 is advanced from a stack of sheets 56 disposed on a tray. A friction retard feeder 58 advances the uppermost sheet from stack 56 onto a pre-transfer transport 60. Transport 60 advances sheet 25 to sheet transport 48. Sheet 25 is advanced by transport 60 in synchronism with the movement of the sheet gripper. In this way, the leading edge of sheet 25 arrives at a preselected position, i.e. loading zone, to be received by the open sheet gripper. The sheet gripper then closes securing sheet 25 thereto for movement therewith in a recirculating path. The leading edge of sheet 25 is secured releasably by the sheet gripper. As belts 54 move in the direction of arrow 62, the sheet moves into contact with the photoconductive belt, in synchronism with the toner image developed thereon. In transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used. Each of the electrostatic latent images recorded on the photoconductive surface is developed with the appropriately colored toner and transferred, in superimposed registration with one another, to the sheet to form the multicolor copy of the colored original document.

After the last transfer operation, the sheet transport system directs the sheet to a vacuum conveyor, indicated generally by the reference numeral 68. Vacuum conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to a catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
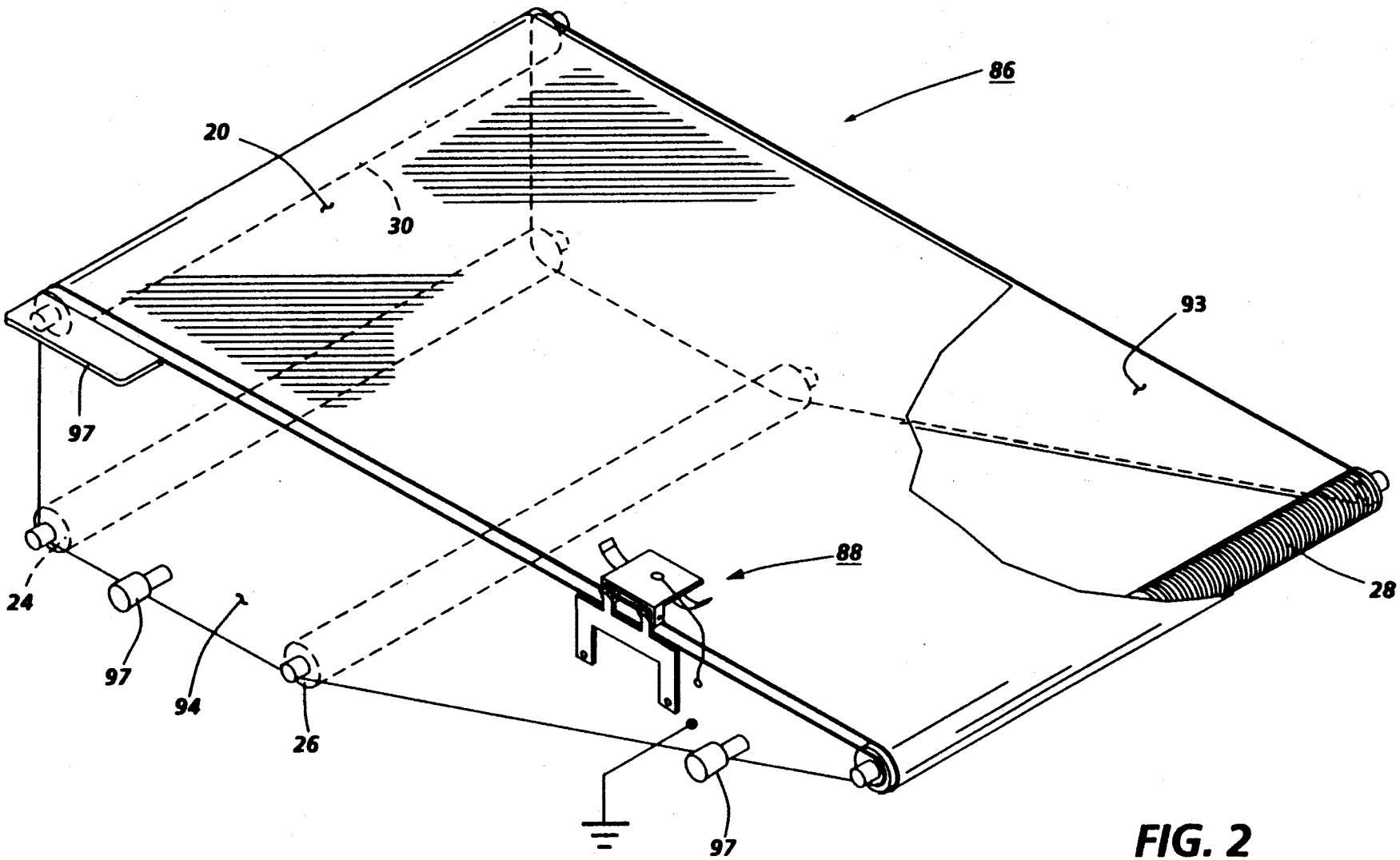
FIG. 2 is a perspective view showing further details of the xerographic module used in the electrophotographic printing machine of FIG. 1.

FIG. 2 shows a xerographic module, generally designated by the reference numeral 86. Module 86 includes photoconductive belt 20, transfer rollers 24 and 26, tensioning roller 28, drive roller 30, grounding mechanism 88, a pair of module sideplates 93 and 94, and a plurality of module legs 97.

Grounding mechanism 88 is shown in more detail in FIGS. 3 and 4. The grounding mechanism includes a conductive brush 96, a support 98, a shaft 100, a base 102, an electrical lead 104 and a brush back-up 106. Conductive brush 96 is attached to support 98. Support 98 is pivotably mounted on a shaft 100 which is, in turn, mounted on base 102. Base 102 is secured to sideplate 94. Brush back-up 106 is also mounted on sideplate 94 and positioned substantially adjacent photoconductive belt 20. Lead 104 is connected at one of its ends to support 98 by a conductive fastener 112 and at its other end to sideplate 94 by another fastener 113. Conductive fastener 112 is in electrical contact with conductive brush 96. Sideplate 94 is electrically coupled to electrical ground. As a result, conductive brush 96 is electrically coupled, via fastener 112, lead 104 and sideplate 94, to electrical ground.

In FIG. 3, conductive brush 96 is shown in contact with a conductive protective covering 108 of photoconductive belt 20. The conductive protective covering is electrically coupled to a conductive layer 110 of the photoconductive belt. Consequently, when grounding mechanism 88 is positioned as shown in FIG. 3, conductive layer 110 is electrically coupled to, or in electrical contact with, electrical ground, via conductive protective covering 108, conductive brush 96, conductive fastener 112, lead 104 and sideplate 94.

Module 86 is positionable within a module drawer 91. Module drawer 91 is insertable within marking engine 18. When module 86 is positioned within module drawer 91 and module drawer 91 is inserted with marking engine 18, as shown in FIG. 3, photoconductive belt 20 is positioned in an operative position. In the operative position, the photoconductive belt is positioned relative to the various xerographic stations (e.g. charging station, exposure station, etc.) so as to be capable of having an electrostatic latent image recorded thereon.

Module drawer 91 is movable, in the direction of arrow 114, from its position shown in FIG. 3 to a position in which module 86 may be removed from the module drawer. Thus, when it is desired to replace photoconductive belt 20 of module 86 of marking engine 18 due to damage or wear or the like, module drawer 91 is moved in the direction of arrow 114, from its position shown in FIG. 3. Once module drawer 91 is located at a position in which module 86 may be removed therefrom, the module is removed from the module drawer and then placed on a floor 116 so that the photoconductive belt is positioned in a replacement position as shown in FIG. 4. In the replacement position, photoconductive belt 20 is positioned relative to the other components of the marking engine 18 so as to be capable of being removed over the remaining module components and replaced with a new photoconductive belt. After the new photoconductive belt has been placed back over the remaining module components, the module is then replaced into module drawer 91 and the module drawer is then reinserted into marking engine 18 thereby locating the photoconductive belt in the operative position.

When the photoconductive belt is moved from the operative position, as shown in FIG. 3, to the replacement position as shown in FIG. 4, the conductive brush moves from being in electrical contact with the conductive layer of the photoconductive belt to being out of electrical contact with the conductive layer of the photoconductive belt. The above automatically occurs since the conductive brush is attached to support 98 and support 98 pivots about shaft 100 when module 86 is moved from its position shown in FIG. 3 to its position shown in FIG. 4. More specifically, support 98 pivots from a first orientation relative to the photoconductive belt as shown in FIG. 3 to a second orientation relative to the photoconductive belt as shown in FIG. 4. Support 98 is prevented from pivoting past its position shown in FIG. 4 due to support 98 contacting a back stop portion 118 of base 102 thereby maintaining the support at the second orientation.

When the photoconductive belt is moved from the replacement position, as shown in FIG. 4, back to the operative position, as shown in FIG. 3, the conductive brush moves from being out of electrical contact with the conductive layer of the photoconductive belt to being in contact with the conductive layer of the photoconductive belt. The above automatically occurs since the conductive brush is attached to support 98 and support 98 is caused to pivot about shaft 100 when module 86 is moved from its position shown in FIG. 4 back to its position shown in FIG. 3. More specifically, support 98 is caused to pivot from its second orientation relative to the photoconductive belt, as shown in FIG. 4, to its first orientation relative to the photoconductive belt, as shown in FIG. 3. Support 98 is prevented from pivoting past its position shown in FIG. 3 due to support 98 contacting a front stop portion 120 of base 102 thereby maintaining the support at the first orientation.

In recapitulation, the grounding apparatus of the present invention includes a conductive brush which is electrically coupled to the reference potential. The apparatus further includes a mechanism for moving the conductive brush into electrical contact with the conductive layer of the photoreceptor in response to the photoreceptor being moved to the operative position and out of electrical contact with the conductive layer of the photoreceptor in response to the photoreceptor being moved to the replacement position.

It is, therefore, apparent that there has been provided in accordance with the present invention, an apparatus for electrically coupling a conductive layer of a photoreceptor to a reference potential that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

We claim:

1. An apparatus for electrically coupling a conductive layer of a photoreceptor to a reference potential, the photoreceptor being mountable on a module and positionable between an operative position and a replacement position, comprising:

an electrically conductive member, said conductive member being electrically coupled to the reference potential; and means for moving said conductive member into physical contact with the conductive layer in response to the photoreceptor being moved to the operative position and out of physical contact with the conductive layer in response to the photoreceptor being moved to the replacement position, the photoreceptor being mounted on the module when the photoreceptor is positioned at the operative position and the replacement position.

2. The apparatus of claim 1, wherein said moving means comprises a support, and said conductive member is mounted on said support.

3. An apparatus for electrically coupling a conductive layer of a photoreceptor to a reference potential, the photoreceptor being positionable between an operative position and a replacement position, comprising:

an electrically conductive member, said conductive member being electrically coupled to the reference potential; and means for moving said conductive member into electrical contact with the conductive layer in response to the photoreceptor being moved to the operative position and out of electrical contact with the conductive layer in response to the photoreceptor being moved to the replacement position wherein said moving means comprises a support, and said conductive member is mounted on said support, and wherein said support is moved to a first orientation relative to the photoreceptor in response to the photoreceptor being moved to the operative position and to a second orientation relative to the photoreceptor in response to the photoreceptor being moved to the replacement position.

4. The apparatus of claim 3, wherein said support is pivotable between the first orientation and the second orientation.

5. The apparatus of claim 3, wherein said conductive member is in electrical contact with the conductive layer when said support is positioned at the first orientation and said conductive member is out of electrical contact with the conductive layer when said support is positioned at the second orientation.

6. The apparatus of claim 5, wherein said conductive member moves in unison with said support as said support is moved between the first orientation and the second orientation.

7. The apparatus of claim 2, wherein said moving means further comprises a shaft mounted substantially adjacent the photoreceptor, said shaft maintains a fixed orientation relative to the photoreceptor as the photoreceptor is moved between the operative position and the replacement position.

8. An apparatus for electrically coupling a conductive layer of a photoreceptor to a reference potential, the photoreceptor being positionable between an operative position and a replacement position, comprising:

an electrically conductive member, said conductive member being electrically coupled to the reference potential; and means for moving said conductive member into electrical contact with the conductive layer in response to the photoreceptor being moved to the operative position and out of electrical contact with the conductive layer in response to the photoreceptor being moved to the replacement position, wherein said moving means comprises a support, and said conductive member is mounted on said support, wherein said moving means further comprises a shaft mounted substantially adjacent the photoreceptor, said shaft maintains a fixed orientation relative to the photoreceptor as the photoreceptor is moved between the operative position and the replacement position, and wherein said support is pivotable about said shaft.

9. A printing machine comprising:

a photoreceptor which is mountable on a module and positionable between an operative position and a replacement position, said photoreceptor comprising an electrically conductive layer;

an electrically conductive member, said conductive member being electrically coupled to a reference potential; and means for moving said conductive member into physical contact with said conductive layer in response to said photoreceptor being moved to the operative position and out of physical contact with said conductive layer in response to said photoreceptor being moved to the replacement position, the photoreceptor being mounted on the module when the photoreceptor is positioned at the operative position and the replacement position.

10. The printing machine of claim 9, wherein said moving means comprises a support, and said conductive member is mounted on said support.

11. A printing machine comprising:

a photoreceptor which is positionable between an operative position and a replacement position, said photoreceptor comprising an electrically conductive layer;

an electrically conductive member, said conductive member being electrically coupled to a reference potential; and means for moving said conductive member into electrical contact with said conductive layer in response to said photoreceptor being moved to the operative position and out of electrical contact with said conductive layer in response to said photoreceptor being moved to the replacement position, wherein said moving means comprises a support, and said conductive member is mounted on said support, and wherein said support is moved to a first orientation relative to the photoreceptor in response to the photoreceptor being moved to the operative position and to a second orientation relative to the photoreceptor in response to the photoreceptor being moved to the replacement position.

12. The printing machine of claim 11, wherein said support is pivotable between the first orientation and the second orientation.

13. The printing machine of claim 11, wherein said conductive member is in electrical contact with said conductive layer when said support is positioned at the first orientation and said conductive member is out of electrical contact with said conductive layer when said support is positioned at the second orientation.

14. The printing machine of claim 13, wherein said conductive member moves in unison with said support as said support is moved between the first orientation and the second orientation.

15. The printing machine of claim 10, wherein said moving means further comprises a shaft mounted substantially adjacent the photoreceptor, said shaft maintains a fixed orientation relative to the photoreceptor as the photoreceptor is moved between the operative position and the replacement position.

16. A printing machine comprising:

a photoreceptor which is positionable between an operative position and a replacement position, said photoreceptor comprising an electrically conductive layer;

an electrically conductive member, said conductive member being electrically coupled to a reference potential; and means for moving said conductive member into electrical contact with said conductive layer in response to said photoreceptor being moved to the operative position and out of electrical contact with said conductive layer in response to said photoreceptor being moved to the replacement position, wherein said moving means comprises a support, and said conductive member is mounted on said support, wherein said moving means further comprises a shaft mounted substantially adjacent the photoreceptor, said shaft maintains a fixed orientation relative to the photoreceptor as the photoreceptor is moved between the operative position and the replacement position, and wherein said support is pivotable about said shaft.

* * * * *